US008666291B2

(12) United States Patent
Ohgoshi et al.

(10) Patent No.: US 8,666,291 B2
(45) Date of Patent: Mar. 4, 2014

(54) DEVELOPER CONTAINER AND IMAGE FORMING APPARATUS

(75) Inventors: Toshihide Ohgoshi, Osaka (JP); Koichi Mihara, Osaka (JP)

(73) Assignee: Sharp Kabushiki Kaisha, Osaka-shi, Osaka (JP)

( * ) Notice: Subject to any disclaimer, the term of this patent is extended or adjusted under 35 U.S.C. 154(b) by 106 days.

(21) Appl. No.: 13/344,131

(22) Filed: Jan. 5, 2012

(65) Prior Publication Data

US 2012/0183333 A1 Jul. 19, 2012

(30) Foreign Application Priority Data

Jan. 13, 2011 (JP) ..... 2011-005119

(51) Int. Cl.
*G03G 15/08* (2006.01)

(52) U.S. Cl.
USPC ..... 399/258; 399/262

(58) Field of Classification Search
None
See application file for complete search history.

(56) References Cited

U.S. PATENT DOCUMENTS

| | | | | |
|---|---|---|---|---|
| 5,648,840 | A * | 7/1997 | Ikunami et al. | 399/262 |
| 6,751,431 | B2 | 6/2004 | Ichikawa et al. | |
| 7,599,648 | B2 | 10/2009 | Koyama et al. | |

FOREIGN PATENT DOCUMENTS

| | | |
|---|---|---|
| JP | 7-20705 | 1/1995 |
| JP | 2007-102135 | 4/2007 |
| JP | 2011-133513 | 7/2011 |

* cited by examiner

*Primary Examiner* — Clayton E LaBalle
*Assistant Examiner* — Jas Sanghera
(74) *Attorney, Agent, or Firm* — Nixon & Vanderhye, P.C.

(57) ABSTRACT

A developer container 1 includes (i) a developer vessel 2, having a cylindrical shape, that carries and discharges toner contained therein through its first discharge opening 31 while the developer vessel 2 is being driven to rotate, and (ii) a developer supply section 3 which (a) supports the developer vessel 2 such that the developer vessel 2 can rotate, (b) temporarily stores the toner discharged from the first discharge opening 31, and (c) discharges the toner outside of the developer supply section 3 from a second discharge opening 5. The first discharge opening 31 is formed in an inclined surface 31*a* of an edge part of the developer vessel 2. The inclined surface 31*a* inclines, upstream of a direction in which the toner is carried along a shaft line L1, so as to be at angles with a surface perpendicular to the shaft line L1.

4 Claims, 6 Drawing Sheets

DEVELOPER CONTAINER AND IMAGE FORMING APPARATUS

This Nonprovisional application claims priority under 35 U.S.C. §119(a) on Patent Application No. 2011-005119 filed in Japan on Jan. 13, 2011, the entire contents of which are hereby incorporated by reference.

TECHNICAL FIELD

The present invention relates to a developer container that contains developer, in particular, relates to (i) a developer container that discharges contained developer by being driven to rotate and (ii) an image forming apparatus including the developer container.

BACKGROUND ART

In an electrophotographic image forming apparatus, an electrostatic latent image formed on a surface of a photoreceptor is made visible by use of toner (developer) by a developing device. The toner used for making the electrostatic latent image visible is contained in a toner container, and sequentially supplied to the developing device from the toner container.

An image forming apparatus that operates at high speed consumes plenty of toner. Therefore, a toner container having a large volume is used in the image forming apparatus. Among these, a toner cartridge that supplies toner to a developing device by rotation of a toner container has been recently known. Most of such rotation-type toner containers are formed into a hollow cylindrical shape, and have a closed edge part and a discharge opening in the vicinity of the other edge part. The toner container is hereinafter referred to as a toner bottle.

A toner cartridge including a toner bottle is provided in an image forming apparatus such that a rotary shaft of the toner bottle becomes horizontal. Some toner bottles have spiral projections on their inner surfaces. The projections provided on each of the inner surfaces transfer toner toward a discharge opening by rotation of the toner bottle around the rotary shaft, so that the toner is discharged from the discharge opening.

The toner cartridge including the toner bottle further includes, near the discharge opening of the toner bottle, a toner supply section that (i) regulates an upper limit of toner quantity to be discharged from the toner bottle and (ii) discharges a certain amount of toner outside of the toner cartridge. In the toner cartridge including the toner supply section, a toner bottle discharge opening 30 is formed in an edge surface of a toner bottle 20, which edge surface is located in the vicinity of a periphery of the toner bottle 20, as shown in FIG. 9. Further, as shown in FIG. 8, a toner supply section 3 includes, above the vicinity of the toner bottle discharge opening 30, a toner discharge position regulatory partition 6 that regulates the toner quantity to be discharged from the toner bottle 20. The toner discharge position regulatory partition 6 causes toner to be discharged from a supply section discharge opening 5 of the toner supply section 3 in a case where the toner bottle discharge opening 30 reaches around a lower side of a toner cartridge 101. The toner discharge position regulatory partition 6 prevents toner discharged from the toner bottle 20 to the toner supply section 3 from flowing back from the toner supply section 3 to the toner bottle 20 in a case where the toner bottle discharge opening 30 reaches around an upper side of the toner cartridge 101.

The toner discharge position regulatory partition 6 allows toner itself contained in the toner bottle 20 to close the toner bottle discharge opening 30 from inside in a case where the toner bottle 20 contains plenty of toner. This prevents outside air from flowing into the toner bottle 20, thereby keeping an inner pressure of the toner bottle 20 so as not to be decreased. Therefore, toner is prevented from being discharged from the toner bottle 20. Consequently, a small amount of toner is discharged.

CITATION LIST

Patent Literature

Patent Literature 1
Japanese Patent Application Publication, Tokukai No. 2007-102135 A (Publication Date: Apr. 19, 2007)

SUMMARY OF INVENTION

Technical Problem

However, according to the conventional technique, it is impossible to stably discharge a certain large amount of toner from a toner cartridge. In particular, it is impossible to stably discharge plenty of toner when a toner bottle starts rotating (during rising edges) or stops rotating (during falling edges).

This brings about a problem that (i) toner to be supplied to a developing device becomes in short supply, (ii) an image defection occurs or (iii) a waiting time for toner supply is prolonged, in a case where an image forming apparatus that operates at high speed is used.

In a case where a rate at which the toner bottle rotates is increased so as to supply plenty of toner, for example, the following problems occur. Cost for obtaining a driving force is risen, or heat is generated due to abrasion or friction of a friction section of the toner bottle.

The present invention was made in view of the problems, and an object of the present invention is to provide (i) a developer container capable of stably supplying a certain large amount of developer and (ii) an image forming apparatus including the developer container.

Solution to Problem

In order to attain the object, a developer container of the present invention is a developer container, including: a developer vessel, having a cylindrical shape, that carries and discharges developer contained therein through its first discharge opening while the developer vessel is being driven to rotate around a shaft line; and a developer supply section including (i) a temporary storing section which surrounds a periphery of the first discharge opening and temporarily stores the developer discharged from the first discharge opening, (ii) a second discharge opening from which the developer is discharged outside of the developer supply section, and (iii) a carrying section that carries the developer from the temporary storing section toward the second discharge opening, said developer supply section supporting the developer vessel such that the developer vessel can rotate around the shaft line, the developer contained in the developer vessel being discharged outside of the developer container through the first discharge opening and the second discharge opening, and the first discharge opening being formed in an inclined surface of an edge part of the developer vessel, the inclined surface inclining, upstream of a direction in which the developer is carried along the shaft line, so as to be at angles with a surface perpendicular to the shaft line.

Advantageous Effects of Invention

According to the configuration, the first discharge opening is formed in the inclined surface of the edge part of the developer vessel. The inclined surface inclines, upstream of the direction in which the developer is carried along the shaft line of the developer vessel, so as to be at angles with the surface perpendicular to the shaft line. Therefore, in a case where the developer vessel contains plenty of developer, the inclined surface makes it easy to stir and flow developer located in the vicinity of the first discharge opening upon the rotation of the developer vessel around the shaft line. The inclined surface also makes it possible to discharge plenty of developer from the developer vessel through the first discharge opening formed in the inclined surface. According to the configuration, it is possible to stably discharge a certain large amount of developer, as compared with a case where the first discharge opening is formed in the surface of the edge part of the developer vessel which surface is perpendicular to the shaft line.

A decrease in amount of developer contained in the developer vessel (i) makes it easy to stir the developer contained in the developer vessel in response to the rotation of the developer vessel and (ii) causes a decrease in time period during which the first discharge opening is closed by the developer contained in the developer vessel. This allows the outside air to easily flow into the developer vessel. Hence, plenty of toner can be continuously discharged.

It is thus possible to stably discharge a certain large amount of developer from the developer container, regardless of quantity of the developer contained in the developer vessel. Further, according to the configuration, the developer container includes the developer supply section which is configured to surround the periphery of the first discharge opening.

This makes it possible to prevent an image forming apparatus from upsizing and cost rise.

DESCRIPTION OF EMBODIMENTS

Embodiment

Figure 2:
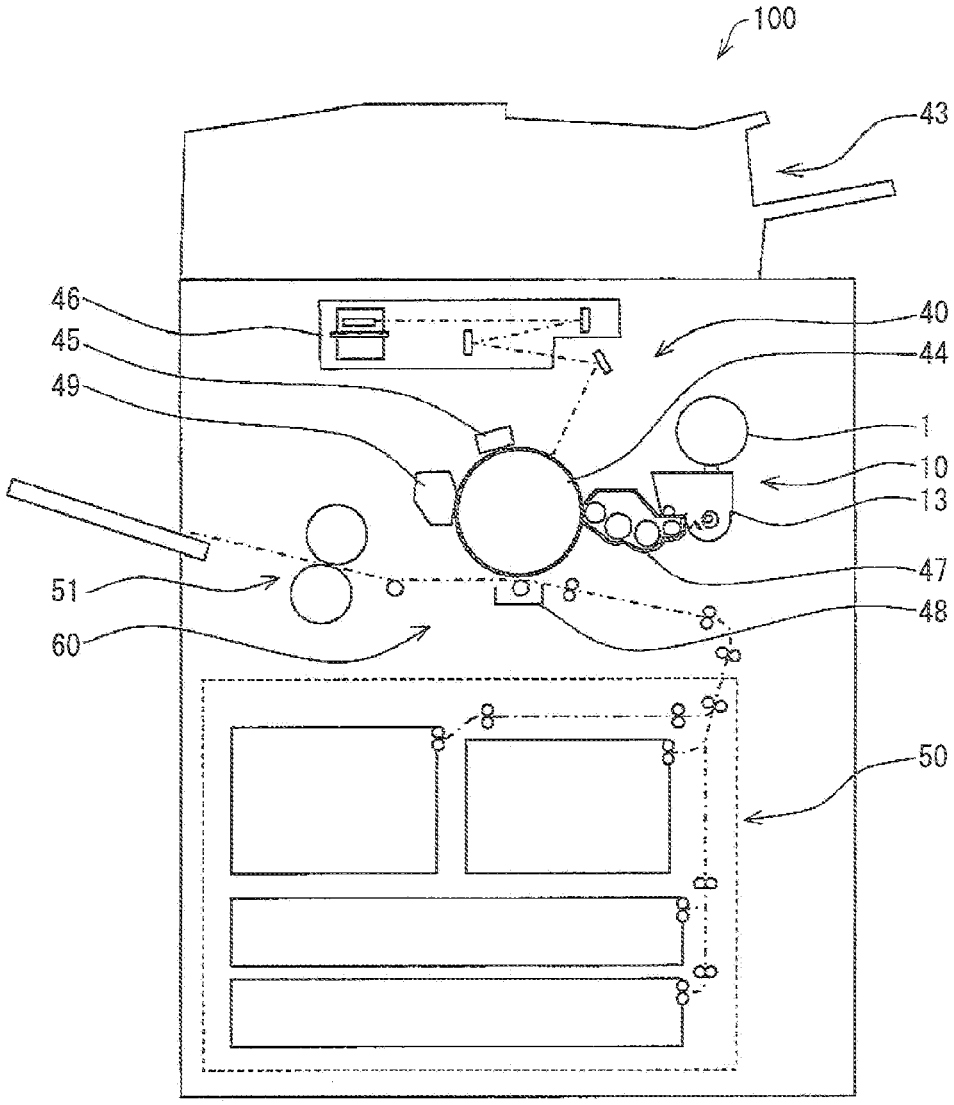
FIG. 2 is an explanatory view illustrating an entire configuration of an image forming apparatus in which a toner cartridge in accordance with an embodiment of the present invention is provided.

The following description will discuss in detail an embodiment of the present invention with reference to drawings. FIG. 2 is an example of an embodiment of the present invention, and is an explanatory drawing illustrating an entire configuration of an image forming apparatus of the present invention. The image forming apparatus employs a later-described toner cartridge (developer container) of the present invention. Note that a copying machine shown in FIG. 2 is exemplified as the image forming apparatus of the present invention. However, the image forming apparatus of the present invention is not limited to the copying machine, provided that it is an apparatus, such as a printer, a facsimile, or a copying machine, which forms an image, i.e., provided that it is an apparatus which forms an image and from which the toner cartridge (later described) of the present invention is detachable.

As shown in FIG. 2, the image forming apparatus 100 includes a document reading section (scanner) 43, an image forming section 40, an electrophotoraphic processing section 60, and a sheet feeding section 50.

The document reading section 43 is provided in an upper part of the image forming apparatus 100, reads a document, and creates image data of a read document. The image forming section 40 is provided under the document reading section 43, and includes a photoreceptor 44, a charging device 45 and an exposure section 46.

The photoreceptor 44 is a substantially cylindrical electrostatic latent image bearing member that is rotatably provided. The photoreceptor 44 has a surface, on which an electrostatic latent image is formed in accordance with (i) image data created by the document reading section 43 or (ii) image data externally supplied through, for example, a communication network. The charging device 45 is a device that uniformly charges the surface of the photoreceptor 44 so that the surface has a predetermined electric potential. Examples of the charging device 45 encompass a contact roller-type charging device, a contact brush-type charging device, and a non-contact charger-type charging device. The exposure section 46 includes a laser beam scanner, and exposes the photoreceptor 44 charged by the charging device 45 in accordance with image data so as to form, on the surface of the photoreceptor 44, an electrostatic latent image in accordance with the image data.

A cleaning section 49 that removes toner left on the surface of the photoreceptor 44 is provided on the periphery of the photoreceptor 44.

The electrophotographic processing section 60 includes a developing device 47, a transfer section 48 and a fixing section 51. The developing device 47 is a device that supplies toner (developer) onto the surface of the photoreceptor 44 on which surface the electrostatic latent image has been formed, so as to develop a toner image in accordance with the electrostatic latent image. There is provided, over the developing device 47, a toner supply device 10 including (i) a toner hopper 13 and (ii) a toner cartridge 1 that contains toner. The toner hopper 13 is configured to receive toner from the toner cartridge 1. The toner cartridge 1 is later described in detail. The transfer section 48 transfers, to a sheet (recording paper or recording material) fed by the sheet feeding section 50, the toner image on the photoreceptor 44 developed by the developing device 47. The fixing section 51 fixes, onto the sheet, the toner image formed on the sheet. The sheet onto which the toner image has been fixed is discharged onto a paper output tray.

Figure 3:
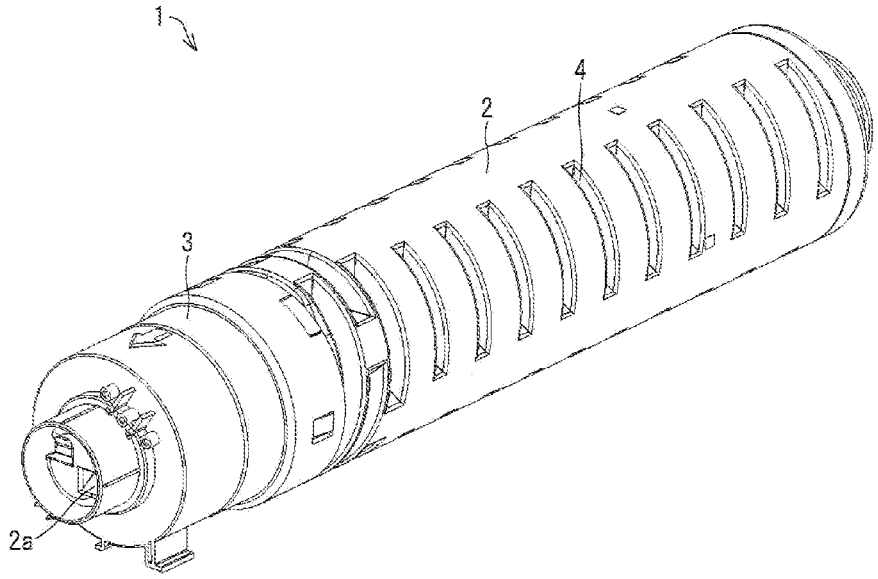
FIG. 3 is a perspective view showing a configuration of a toner cartridge in accordance with an embodiment of the present invention.
Figure 4:
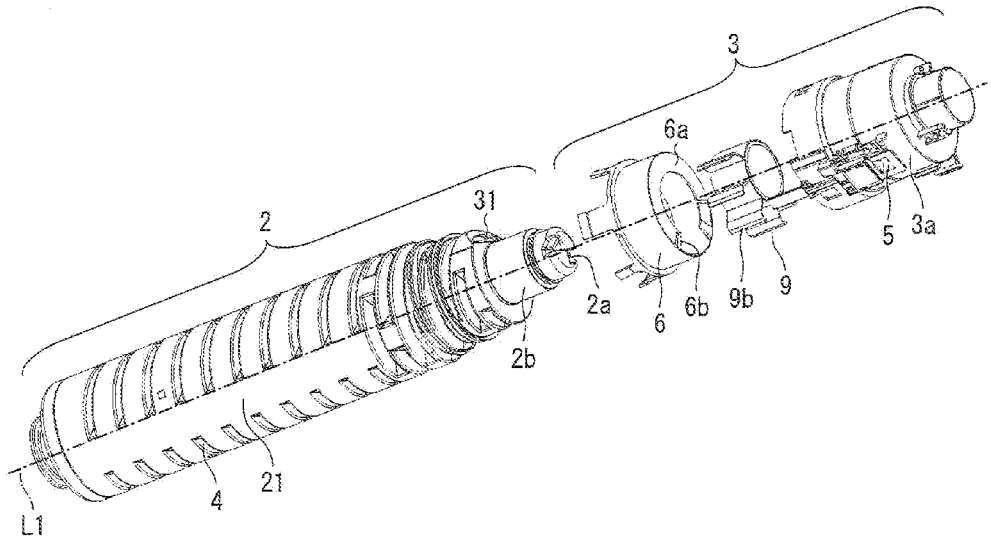
FIG. 4 is an exploded perspective view showing a configuration of a toner cartridge in accordance with an embodiment of the present invention.

The following description will discuss the toner cartridge (developer container) 1 of the present embodiment. As shown in FIGS. 3 and 4, the toner cartridge 1 includes a cylindrical toner bottle (developer vessel) 2 and a toner supply section (developer supply section) 3.

The toner bottle 2 includes (i) a cylindrical toner containing section 21, which has a bottom, for containing toner (developer) to be supplied and (ii) a toner bottle discharge opening (first discharge opening) from which the toner contained in the toner containing section 21 is discharged. The toner bottle 2 is driven and rotated around a shaft line L1 so as to carry and discharge the developer contained in the toner containing section 21 from the toner bottle discharge opening 31.

The toner supply section 3 includes (i) a temporary storing section which (a) surrounds a periphery of the toner bottle discharge opening 31, (b) temporarily stores the developer discharged from the toner bottle discharge opening 31, and (c) corresponds to an inner side of a toner supply section outer wall 3*a*, (ii) a supply section discharge opening 5 from which the toner is discharged, and (iii) a carrying member 9 that carries the toner from the temporary storing section to the supply section discharge opening 5. The toner supply section 3 surrounds an entire peripheral surface of a part of the toner bottle 2, including the toner bottle discharge opening 31, and supports the toner bottle 2 such that the toner bottle 2 can rotate around the shaft line (center shaft) L1.

The rotation of the toner bottle 2 causes the toner contained in the toner containing section 21 to be discharged from the toner bottle discharge opening 31 to the toner supply section 3. Thereafter, the toner is discharged from the toner supply section 3 to outside of the toner cartridge 1, through the supply section discharge opening 5.

As shown in FIGS. 3 and 4, there are provided on an inner surface of the toner bottle 2, a plurality of toner guide projections 4 that are a plurality of convexities projecting inward the toner containing section 21. The plurality of toner guide projections 4 are separately (intermittently) provided, in a spiral manner, in a direction in which the toner bottle 2 rotates. This causes the toner bottle 2 to rotate around the shaft line L1. As such, the toner contained in the toner containing section 21 is carried (guided) along the plurality of toner guide projections 4 toward the toner bottle discharge opening 31.

A stirring pedestal 2*b*, cylindrically projecting, which includes a driving connection depression 2*a* is provided in an edge part (front edge part) of the toner bottle 2 which edge part is located downstream of a direction in which toner is carried along the shaft line L1. As shown in FIG. 4, the stirring pedestal 2*b* is provided in a cylindrical manner so as to have a diameter smaller than that of the toner containing section 21. The toner bottle 2 is connected to the image forming apparatus 100 through the driving connection depression 2*a*, and receives a rotation driving force from a main body of the image forming apparatus 100.

Figure 1:
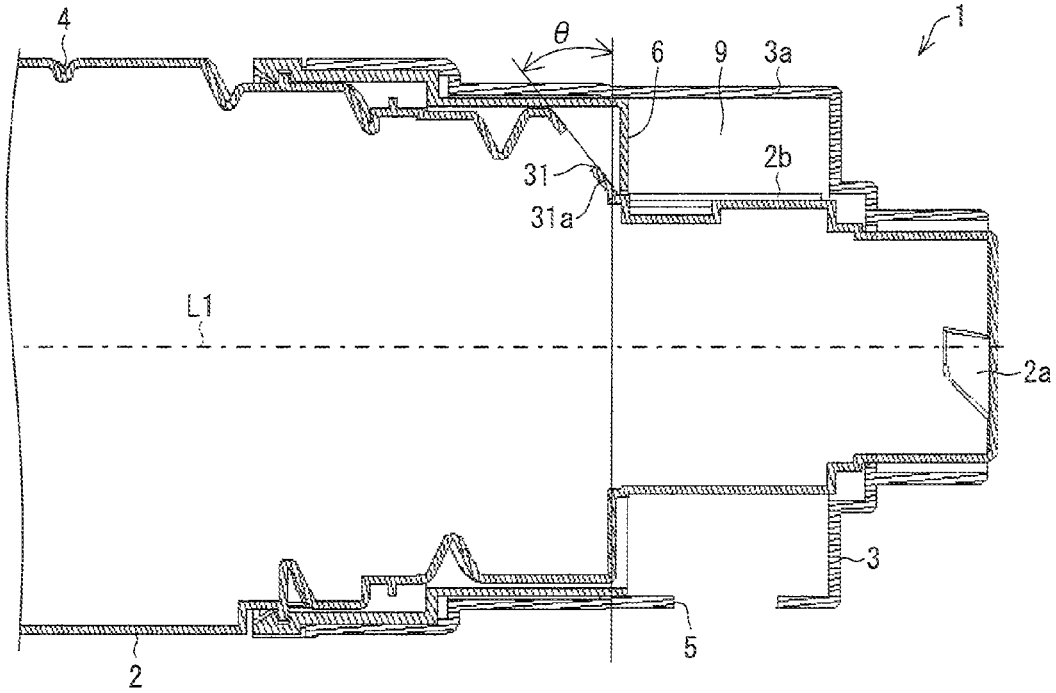
FIG. 1 is a cross-sectional view showing a configuration of a toner supply section and its surroundings of a toner cartridge in accordance with an embodiment of the present invention.
Figure 5:
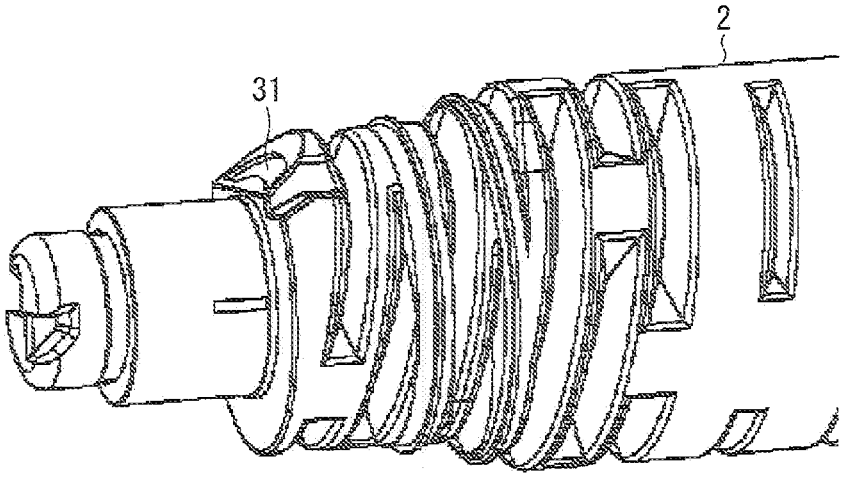
FIG. 5 is a perspective view showing a discharge opening and it surroundings of a toner bottle of a toner cartridge in accordance with an embodiment of the present invention.

As shown in FIG. 1, the toner bottle discharge opening 31 is formed in an inclined surface 31*a* of an edge part of the toner bottle 2. The inclined surface 31*a* inclines, upstream of the direction in which developer is carried along the shaft line L1, so as to be at an angle with a surface perpendicular to the shaft line L1. The toner contained in the toner containing section 21 is discharged from the toner bottle discharge opening 31 toward the toner supply section 3. FIG. 5 shows a shape of the toner bottle discharge opening 31 and its surroundings.

Figure 8:
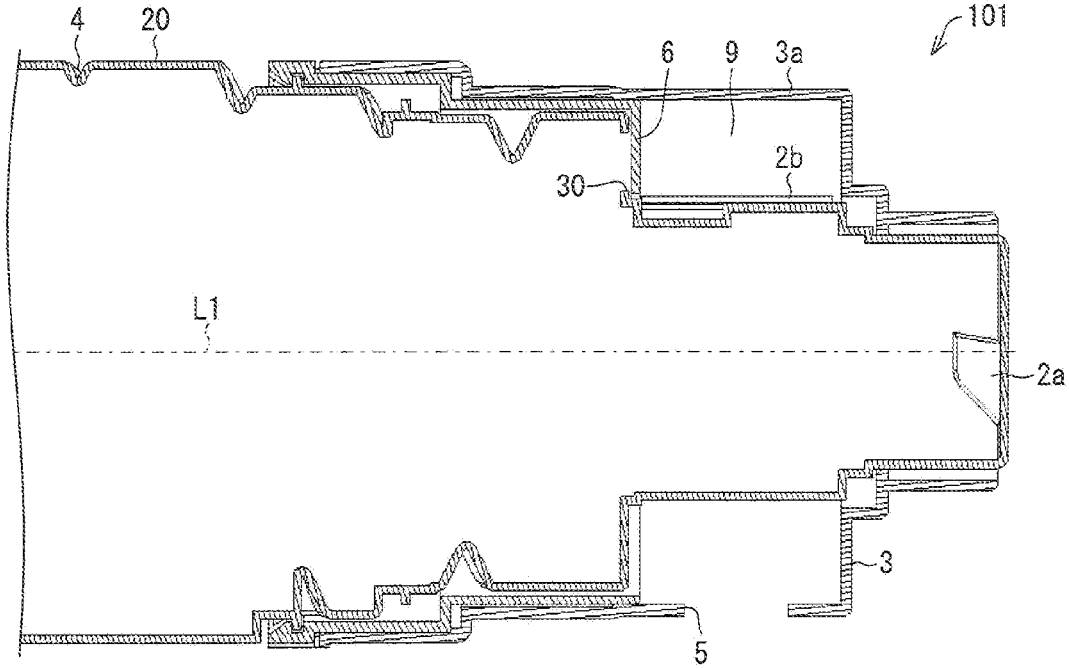
FIG. 8 is a cross-sectional view showing a configuration of a toner supply section and its surroundings of a conventional toner cartridge.
Figure 9:
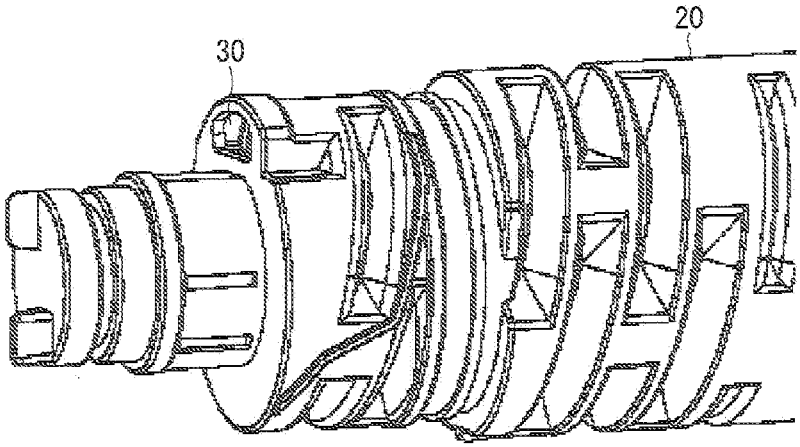
FIG. 9 is a perspective view showing a first discharge opening and its surroundings of a toner bottle of a conventional toner cartridge.

Note that, according to a conventional toner cartridge 101, a toner bottle discharge opening 30 is formed in a surface of an edge part of a toner bottle 20, which surface is parallel to a surface perpendicular to a rotary shaft (shaft line L1) of the toner bottle 20 (see FIG. 8). Toner contained in a toner containing section 21 is discharged toward a toner supply section 3. FIG. 9 shows a shape of the toner bottle discharge opening 30 and its surroundings of the conventional toner cartridge 101.

In contrast, according to the toner cartridge 1 of the preset embodiment, the toner bottle discharge opening 31 is formed as described above. The inclined surface 31*a* makes it easy to stir and flow toner located in the vicinity of the first discharge opening upon rotation of the toner bottle 2 around the shaft line L1, in a case where the toner bottle 2 contains plenty of toner. The inclined surface 31*a* also makes it possible to discharge plenty of toner from the toner bottle 2 through the toner bottle discharge opening 31 formed in the inclined surface 31*a*. According to the configuration of the present embodiment, it is possible to stably discharge a certain large amount of toner, as compared with the conventional toner cartridge 101 in which the toner bottle discharge opening 30 is formed in the surface parallel to the surface perpendicular to the shaft line L1 of the toner bottle 20.

A decrease in amount of toner contained in the tone bottle 2 (i) makes it easy to stir the toner contained in the toner bottle 2 in response to the rotation of the toner bottle 2 and (ii) causes a decrease in time period during which the toner discharge opening 31 is closed by the toner contained in the toner bottle 2. This allows the outside air to easily flow into the toner bottle 2. Hence, plenty of toner can be continuously discharged.

It is thus possible that the toner cartridge 1 of the present embodiment stably discharges a certain large amount of toner from the toner cartridge 1, regardless of quantity of the toner contained in the toner containing section 21. Further, the toner cartridge 1 includes the toner supply section 3 which is configured to surround the periphery of the toner discharge opening 31. This makes it possible to prevent an image forming apparatus from upsizing and cost rise.

It is preferable to configure the toner cartridge 1 of the present embodiment such that the angle θ of the inclined surface 31*a* fall within a range from 20° to 60°. The angle θ, which falls within the range from 20° to 60°, makes it possible to properly and stably discharge a certain large amount of toner from the toner bottle discharge opening 30.

It is preferable that the angle θ of the inclined surface 31*a* increase as the image forming apparatus 100 operates at higher speed.

As shown in FIG. 4, the toner supply section 3 further includes a toner discharge position regulatory partition (discharge quantity regulatory section) 6, in addition to the toner carrying member 9, the toner supply section outer wall 3*a*, and the supply section discharge opening (second discharge opening) 5. The toner supply section 3 supports the toner bottle 2 so as to surround the entire periphery of the part of the toner bottle 2.

Figure 6:
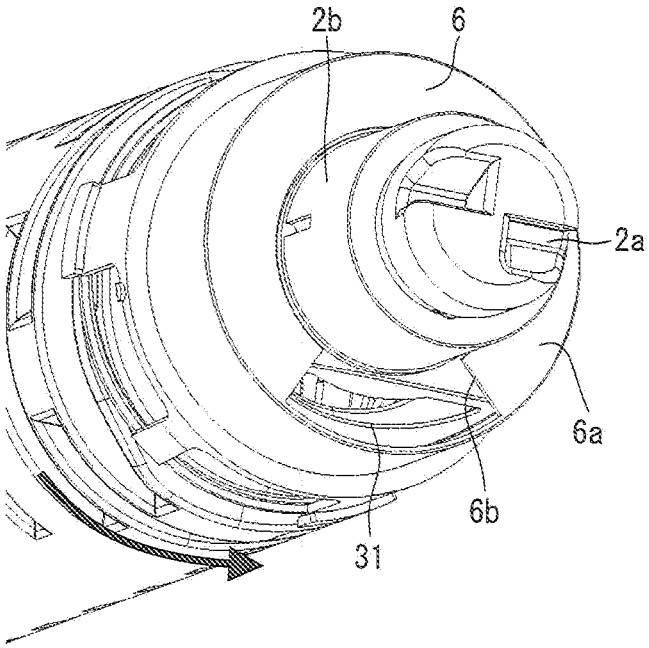
FIG. 6 is a perspective view showing a shape of a toner discharge position regulatory partition of a toner supply section of a toner cartridge in accordance with an embodiment of the present invention.

As shown in FIG. 6, the toner discharge position regulatory partition 6 has a surface 6*a* which (i) is parallel to the surface perpendicular to the shaft line L 1 and (ii) covers the toner discharge opening 31. The surface 6*a* has a cutout (opening) 6*b* through which toner flows into the temporary storing section of the toner supply section 3 from the toner bottle 2 when the toner discharge opening 31 reaches, in response to the rotation of the toner bottle 2, around a lower side of the toner bottle 2 in a direction in which the toner bottle 2 is placed (in a lower side of the toner cartridge 1). With the configuration, when the toner bottle discharge opening 31 passes the cutout 6*b* in response to the rotation of the toner bottle 2, it is possible to (i) discharge the toner contained in the toner bottle 2 toward the toner supply section 3 and (ii) prevent toner, drawn by a toner carrying blade 9*b* (later described), from flowing back from the toner supply section 3 to the toner bottle 2. Hence, it is possible to stabilize toner quantity to be discharged outside of the toner cartridge 1 from the supply section discharge opening 5.

Figure 7:
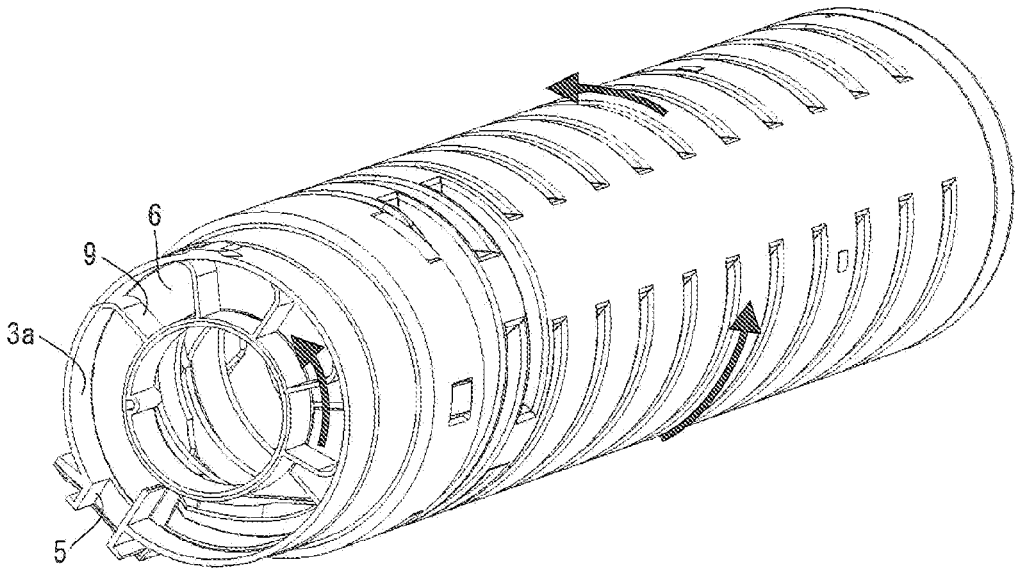
FIG. 7 is a perspective view showing an inner configuration of a discharge opening and its surroundings of a toner supply section of a toner cartridge in accordance with an embodiment of the present invention.

FIG. 7 is a perspective view obtained when the toner cartridge 1 is cut so that the supply section discharge opening 5 of the toner supply section 3 is exposed. As shown in FIG. 7, the toner discharged from the toner bottle 2 toward the toner supply section 3 is carried to the supply section discharge opening 5 by the toner carrying member 9 that rotates in synchronization with the rotation of the toner bottle 2, and is then discharged outside of the toner cartridge 1. Note that the toner carrying member 9 includes a toner carrying blade 9*b* so as to stir and carry toner.

The following effect is brought about by the toner discharge position regulatory partition 6 having the cutout 6*b*. Toner is easily discharged in the gravitational direction from the toner discharge opening 31 formed in the inclined surface 31*a*, when the toner discharge opening 31, formed in the inclined surface 31*a*, (i) reaches, in response to the rotation of the toner bottle 2, around a lower side in the direction in which the toner bottle 2 is placed and then (ii) passes through the cutout 6*b*. The toner is discharged from the toner discharge opening 31 through the cutout 6*b* toward the toner supply section 3. Meanwhile, when the toner discharge opening 31 reaches, in response to the rotation of the toner bottle 2, around an upper side in the direction in which the toner bottle 2 is placed, outside air easily flows into the toner bottle 2 through an interspace between (a) the toner discharge opening 31 formed in the inclined surface 31*a* and (*b*) the surface 6*b* of the toner discharge position regulatory partition 6, which surface 6*b* is parallel to the surface perpendicular to the shaft line L1. Therefore, plenty of toner can be discharged from the toner bottle 2.

Note that the present embodiment describes an example in which the toner cartridge 1 of the present invention is applied to the image forming apparatus 100 shown in FIG. 2. However, the present embodiment is not limited to the above-configured image forming apparatus or copying machine. The present embodiment can be applied to another image forming apparatus or the like, provided that the another image forming apparatus or the like includes a toner cartridge and a developing device and needs to be supplied developer (toner).

Example

An experiment was carried out. In the experiment, a relationship between quantity of toner left in a toner bottle and quantity of toner discharged from a toner cartridge was analyzed by use of (i) the toner cartridge 1 of the present embodiment in which the angle θ of the inclined surface 31*a* of the toner bottle 2 was 40° (Example) and (ii) the conventional toner cartridge 101 (Comparative Example) shown in FIGS. 8 and 9. In this experiment, the toner cartridge of Example was configured identically to the toner cartridge of Comparative Example, except that the angle θ of a surface in which a discharge opening of a toner bottle was formed was 40° in Example, whereas an angle θ of a surface in which a discharge opening of a toner bottle was formed was 0° in Comparative Example.

Note that the discharge openings of the toner bottles of Example and Comparative Example had an identical surface area. Further, toner contained in the toner bottle of Example was identical in quantity to that of Comparative Example.

Figure 10:
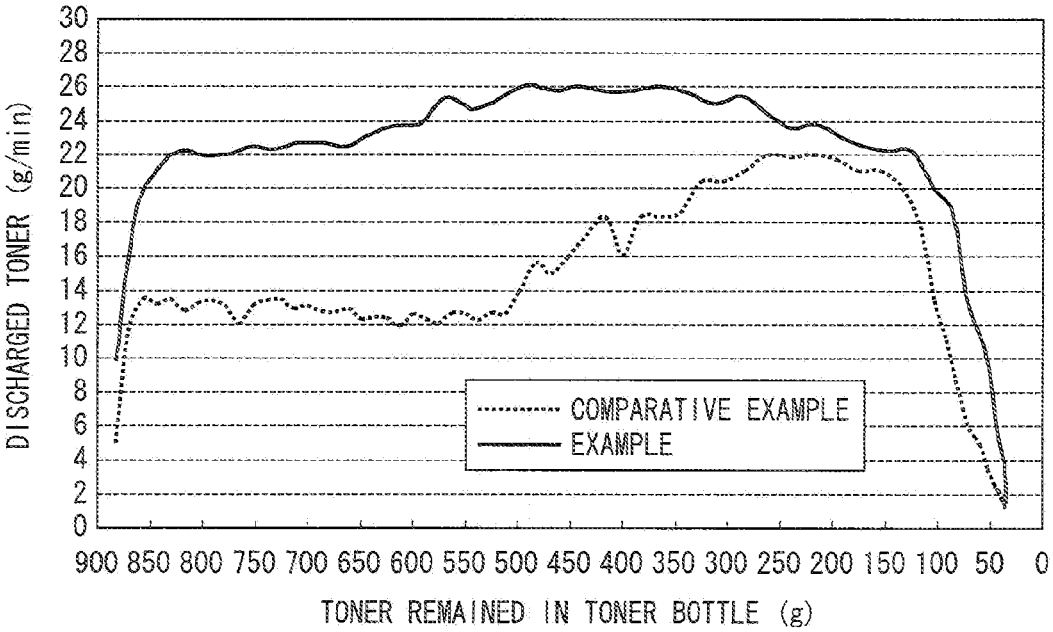
FIG. 10 is a graph in which toner discharge quantity of a toner cartridge of Example is compared to that of Comparative Example.

Table 1 and FIG. 10 show results obtained by this experiment. As is clear from FIG. 10, in Example, a larger amount of toner was stably discharged, as compared with Comparative Example. As is clear from Table 1, quantity of discharging toner became stable earlier in Example than in Comparative Example, during their respective rising edges at which plenty of toner was remained in each of the toner bottles. Further, toner was stably discharged from the toner bottle of Example for a longer time period, as compared with that of Comparative Example even in a case where quantity of remained toner in each of the toner bottles became less (during falling edges).

TABLE 1

| COMPARATIVE EXAMPLE | | | EXAMPLE | | |
|---|---|---|---|---|---|
| TIME (MINUTE) | REMAINED TONER (g) | DISCHARGED TONER (g/MINUTE) | TIME (MINUTE) | REMAINED TONER (g) | DISCHARGED TONER (g/MINUTE) |
| 1 | 882.0 | 5.0 | 1 | 882.0 | 9.8 |
| 2 | 870.4 | 11.6 | 2 | 863.5 | 18.5 |
| 3 | 856.9 | 13.5 | 3 | 842.3 | 21.2 |
| 4 | 843.7 | 13.2 | 4 | 820.1 | 22.2 |
| 5 | 830.2 | 13.5 | 5 | 798.2 | 21.9 |
| 6 | 817.4 | 12.8 | 6 | 776.2 | 22.0 |
| 7 | 804.1 | 13.3 | 7 | 753.7 | 22.5 |
| 8 | 790.7 | 13.4 | 8 | 731.4 | 22.3 |
| 9 | 777.6 | 13.1 | 9 | 708.7 | 22.7 |
| 10 | 765.5 | 12.1 | 10 | 686.0 | 22.7 |
| 11 | 752.4 | 13.1 | 11 | 663.5 | 22.5 |
| 12 | 739.0 | 13.4 | 12 | 640.3 | 23.2 |
| 13 | 725.6 | 13.5 | 13 | 616.6 | 23.7 |
| 14 | 712.7 | 12.9 | 14 | 592.8 | 23.8 |
| 15 | 699.6 | 13.1 | 15 | 567.4 | 25.4 |
| 16 | 686.8 | 12.8 | 16 | 542.7 | 24.7 |
| 17 | 674.1 | 12.7 | 17 | 517.4 | 25.3 |
| 18 | 661.2 | 12.9 | 18 | 491.3 | 26.1 |
| 19 | 648.9 | 12.3 | 19 | 465.5 | 25.8 |
| 20 | 636.4 | 12.5 | 20 | 439.5 | 26.0 |
| 21 | 624.0 | 12.4 | 21 | 413.8 | 25.7 |
| 22 | 612.1 | 11.9 | 22 | 388.0 | 25.8 |
| 23 | 599.5 | 12.6 | 23 | 362.0 | 26.0 |
| 24 | 587.2 | 12.3 | 24 | 336.4 | 25.6 |
| 25 | 575.1 | 12.1 | 25 | 311.5 | 25.0 |
| 26 | 562.4 | 12.7 | 26 | 286.0 | 25.5 |
| 27 | 549.8 | 12.6 | 27 | 261.6 | 24.4 |
| 28 | 537.6 | 12.2 | 28 | 237.9 | 23.6 |
| 29 | 524.9 | 12.7 | 29 | 214.1 | 23.8 |
| 30 | 512.3 | 12.6 | 30 | 191.1 | 23.0 |
| 31 | 498.4 | 13.9 | 31 | 168.7 | 22.4 |
| 32 | 482.8 | 15.6 | 32 | 146.5 | 22.2 |
| 33 | 467.8 | 15.0 | 33 | 124.3 | 22.2 |
| 34 | 451.9 | 15.9 | 34 | 104.2 | 20.1 |
| 35 | 434.7 | 17.2 | 35 | 85.6 | 18.6 |
| 36 | 416.4 | 18.3 | 36 | 71.9 | 13.7 |
| 37 | 400.4 | 16.0 | 37 | 60.3 | 11.6 |
| 38 | 382.1 | 18.3 | 38 | 50.8 | 9.5 |
| 39 | 363.8 | 18.3 | 39 | 44.2 | 6.6 |
| 40 | 345.2 | 18.6 | 40 | 39.7 | 4.5 |
| 41 | 324.8 | 20.4 | 41 | 36.0 | 3.7 |
| 42 | 304.4 | 20.4 | 42 | 34.5 | 1.5 |
| 43 | 283.3 | 21.0 | | | |
| 44 | 261.3 | 22.0 | | | |
| 45 | 239.5 | 21.8 | | | |
| 46 | 217.5 | 22.0 | | | |
| 47 | 195.8 | 21.7 | | | |
| 48 | 174.8 | 21.0 | | | |

TABLE 1-continued

| COMPARATIVE EXAMPLE | | | EXAMPLE | | |
|---|---|---|---|---|---|
| TIME (MINUTE) | REMAINED TONER (g) | DISCHARGED TONER (g/MINUTE) | TIME (MINUTE) | REMAINED TONER (g) | DISCHARGED TONER (g/MINUTE) |
| 49 | 153.8 | 21.0 | | | |
| 50 | 133.8 | 20.0 | | | |
| 51 | 116.0 | 17.8 | | | |
| 53 | 91.5 | 11.1 | | | |
| 54 | 82.8 | 8.7 | | | |
| 55 | 75.7 | 7.1 | | | |
| 56 | 69.8 | 5.9 | | | |
| 57 | 64.4 | 5.4 | | | |
| 58 | 59.5 | 4.9 | | | |
| 59 | 55.4 | 4.1 | | | |
| 60 | 51.9 | 3.5 | | | |
| 61 | 48.8 | 3.1 | | | |
| 62 | 46.1 | 2.7 | | | |
| 63 | 43.7 | 2.4 | | | |
| 64 | 41.5 | 2.2 | | | |
| 65 | 39.8 | 1.8 | | | |
| 66 | 38.3 | 1.5 | | | |
| 67 | 36.9 | 1.3 | | | |
| 68 | 35.8 | 1.1 | | | |

Configuration of the Present Invention

A developer container of the present invention is a developer container, including: a developer vessel, having a cylindrical shape, that carries and discharges developer contained therein through its first discharge opening while the developer vessel is being driven to rotate around a shaft line; and developer supply section including (i) a temporary storing section which surrounds a periphery of the first discharge opening and temporarily stores the developer discharged from the first discharge opening, (ii) a second discharge opening from which the developer is discharged outside of the developer supply section, and (iii) a carrying section that carries the developer from the temporary storing section toward the second discharge opening, said developer supply section supporting the developer vessel such that the developer vessel can rotate around the shaft line, the developer contained in the developer vessel being discharged outside of the developer container through the first discharge opening and the second discharge opening, and the first discharge opening being formed in an inclined surface of an edge part of the developer vessel, the inclined surface inclining, upstream of a direction in which the developer is carried along the shaft line, so as to be at angles with a surface perpendicular to the shaft line.

According to the configuration, it is possible to stably discharge a certain large amount of developer from the developer container regardless of quantity of the developer contained in the developer vessel.

It is preferable to further configure the developer container of the present invention such that the developer supply section include a discharge quantity regulatory section which (i) covers the first discharge opening and (ii) has a surface parallel to the surface perpendicular to the shaft line, in which surface an opening is formed, through which opening the developer is put through to the temporary storing section from the developer vessel when the first discharge opening reaches, in response to the rotation of the developing vessel, around a lower side in a direction in which the developing vessel is placed.

According to the configuration, the discharge quantity regulatory section makes it easy to discharge the developer in the gravitational direction from the first discharge opening formed in the inclined surface, when the first discharge opening, formed in the inclined surface, (i) reaches, in response to the rotation of the developer vessel, around the lower side in the direction in which the developer vessel is placed, and then (ii) passes through the opening. The developer is discharged from the first discharge opening through the opening toward the developer supply section. Meanwhile, when the first discharge opening reaches, in response to the rotation of the developer vessel, around an upper side in the direction in which the developer vessel is placed, outside air easily flows into the developer vessel through an interspace between the first discharge opening formed in the inclined surface and the surface of the discharge quantity regulatory section, which surface is parallel to the surface perpendicular to the shaft line. Therefore, plenty of developer can be discharged from the developer vessel.

It is preferable to further configure the developer container of the present invention such that the inclined surface incline, upstream of the direction in which the developer is carried along the shaft line, so as to be at angle of 20° to 60° with the surface perpendicular to the shaft line.

According to the configuration, the inclined surface that inclines from 20° to 60° makes it possible to properly and stably discharge a certain large amount of developer from the first discharge opening.

It is preferable to configure the developer container of the present invention such that the developer vessel have an inner surface on which a plurality of convexities that project inward the developer vessel are in an intermittently spiral manner.

According to the configuration, the developer vessel has the inner surface on which the plurality of convexities that project inward the developer vessel are in the intermittently spiral manner. This causes the developer vessel to rotate around the shaft line. As such, the developer contained in the developer vessel is carried to the first discharge opening while being properly stirred by the plurality of convexities.

In order to attain the object, an image forming apparatus of the present invention is an image forming apparatus, from which the above-described developer container is detachable.

According to the configuration, the above-described developer container is detachable from the image forming apparatus of the present invention. Therefore, it is possible to always supply a moderate amount of developer to the developer container so as to develop an image. Appropriate supply of the developer allows image forming with an appropriate image quality. It is also possible to prevent an image forming apparatus from upsizing and cost rise.

Note that the developer container includes the developer supply section. Therefore, the developer container can be applied to an image forming apparatus that includes no developer supply device between a developer container and a developing device.

The present invention is not limited to the description of the embodiments above, and can therefore be modified by a skilled person in the art within the scope of the claims. Namely, an embodiment derived from a proper combination of technical means disclosed in different embodiments is encompassed in the technical scope of the present invention.

INDUSTRIAL APPLICABILITY

The present invention is applicable to a toner cartridge for use in an electrophotographic image forming apparatus such as a printer, a copying machine, a facsimile, or a multifunction peripheral (MFP: Multi Function Printer).

REFERENCE SIGNS LIST

1: toner cartridge (developer container)
2: toner bottle (developer vessel)

2*a*: driving connection depression
3: toner supply section (developer supply section)
3*a*: toner supply section outer wall
4: toner guide projection (convexity)
5: supply section discharge opening (second discharge opening)
6: toner discharge position regulatory partition (discharge quantity regulatory section)
6*a*: surface
6*b*: cutout (opening)
9: toner carrying member
9*b*: toner carrying blade
10: toner supply device
21: toner containing section
30: toner bottle discharge opening
31: toner bottle discharge opening (first discharge opening)
31*a*: inclined surface
47: developing device
100: image forming apparatus
101: conventional toner cartridge

The invention claimed is:

1. A developer container, comprising:

a developer vessel, having a cylindrical shape, that carries and discharges developer contained therein through its first discharge opening while the developer vessel is being driven to rotate around a shaft line; and a developer supply section including (i) a temporary storing section which surrounds a periphery of the first discharge opening and temporarily stores the developer discharged from the first discharge opening, (ii) a second discharge opening from which the developer is discharged outside of the developer supply section, and (iii) a carrying section that carries the developer from the temporary storing section toward the second discharge opening, said developer supply section supporting the developer vessel such that the developer vessel can rotate around the shaft line, the developer contained in the developer vessel being discharged outside of the developer container through the first discharge opening and the second discharge opening, the first discharge opening being formed in an inclined surface of an edge part of the developer vessel, the inclined surface inclining, upstream of a direction in which the developer is carried along the shaft line, so as to be at angles with a surface perpendicular to the shaft line; and the developer supply section includes a discharge quantity regulatory section which (i) covers the first discharge opening and (ii) has a surface parallel to the surface perpendicular to the shaft line, in which surface an opening is formed, through which opening the developer is put through to the temporary storing section from the developer vessel when the first discharge opening reaches, in response to the rotation of the developing vessel, around a lower side in a direction in which the developing vessel is placed.

2. The developer container as set forth in claim 1, wherein:

the inclined surface inclines, upstream of the direction in which the developer is carried along the shaft line, so as to be at angle of 20° to 60° with the surface perpendicular to the shaft line.

3. The developer container as set forth in claim 1, wherein:

the developer vessel has an inner surface on which a plurality of convexities that project inward the developer vessel are in an intermittently spiral manner.

4. An image forming apparatus, from which a developer container as set forth in claim 1 is detachable.

* * * * *